United States Patent [19]

Duffin

[11] Patent Number: 5,061,385

[45] Date of Patent: Oct. 29, 1991

[54] FABRIC-TREATMENT COMPOSITION COMPRISING A MIXTURE OF A LIQUID HYDROCARBON AND A SOLID OR SEMISOLID HYDROCARBON AND A WATER-INSOLUBLE CATIONIC MATERIAL

[75] Inventor: Bryan Duffin, Bebington, Great Britain

[73] Assignee: Lever Brothers Company, Division of CONOPCO, Inc., New York, N.Y.

[21] Appl. No.: 435,857

[22] Filed: Nov. 13, 1989

[30] Foreign Application Priority Data

Nov. 28, 1988 [GB] United Kingdom ..... 8827697

[51] Int. Cl.[5] ..... D06M 13/46; D06M 13/322; D06M 13/02; C11D 7/32

[52] U.S. Cl. ..... 252/88; 252/86; 252/154; 252/547

[58] Field of Search ..... 252/8.6, 8.8, 159, 547

[56] References Cited

U.S. PATENT DOCUMENTS 3,936,537 2/1976 Baskerville, Jr. et al. ..... 252/547

4,149,978 4/1979 Goffinet ..... 252/8.6

FOREIGN PATENT DOCUMENTS 0013780 8/1980 European Pat. Off. .
0018039 10/1980 European Pat. Off. .
0032267 7/1981 European Pat. Off. .
0043622 1/1982 European Pat. Off. .
0059502 9/1982 European Pat. Off. .
0079746 5/1983 European Pat. Off. .
1601360 10/1978 United Kingdom .
2007734 5/1979 United Kingdom .

*Primary Examiner*—Paul Lieberman
*Assistant Examiner*—J. Darland
*Attorney, Agent, or Firm*—Ronald A. Koatz

[57] ABSTRACT

An aqueous liquid fabric-treatment composition comprising:

i) a water-insoluble cationic fabric-conditioning material, and ii) a hydrocarbon composition having a thermal phase transition temperature, as measured by the Perkin & Elmer thermal analysis system, of between 27° and 38° C.

6 Claims, No Drawings

FABRIC-TREATMENT COMPOSITION COMPRISING A MIXTURE OF A LIQUID HYDROCARBON AND A SOLID OR SEMISOLID HYDROCARBON AND A WATER-INSOLUBLE CATIONIC MATERIAL

The present invention relates to a fabric-treatment composition, which is especially suitable for use in the rinse cycle of a fabric-washing process. In particular, the present invention relates to a fabric-treatment composition comprising a water-insoluble cationic fabric-conditioning material and a hydrocarbon material.

It has been suggested in GB 2,007,734 to combine a water-insoluble cationic conditioning material and a material having oily/fatty properties in a fabric-treatment concentrate. These concentrates, however, are disadvantageous in that they can often not easily be diluted to form well dispersed liquid fabric-treatment compositions, especially of high active level, without the addition of substantial amounts of solvents to aid dispersion.

It has also been suggested in GB 1,601,360 to incorporate a water-insoluble cationic material and a hydrocarbon material into a fabric-treatment composition, the weight ratio of water-insoluble cationic material to hydrocarbon material being between 5:1 and 1:3, for enhanced ease of ironing, antiwrinkling and reduced material costs. The preferred hydrocarbon materials for use in these compositions are liquid at ambient temperature.

It may be desirable to form fabric-treatment compositions comprising substantial amounts of materials which are less costly than conventional cationic fabric-treatment materials.

It may also be desirable to develop fabric-treatment compositions which provide additional anti-wrinkling benefits, while maintaining an acceptable level of softening performance. It is often also desirable to formulate fabric-treatment compositions of relatively high active level, for reducing packaging costs.

Surprisingly, it has been found that fabric-treatment compositions fulfilling one or more of the above-defined objectives can be formulated by using a combination of a water-insoluble cationic fabric-conditioning material and a specific mixture of hydrocarbons. In particular, it has been found that a mixture of hydrocarbons which has a thermal phase transition temperature (TPTT), as measured by the Perkin & Elmer thermal analysis system, of between 27° and 38° C. is specifically advantageous.

The Perkin & Elmer thermal analysis system measures the heat flow into a material to be heated as a function of the temperature of the material. By investigating a material at various temperatures, a temperature profile is obtained. Such a temperature profile usually has one or more peaks, each peak corresponding to a maximum for the heat flow into the material at a specific temperature. The temperature corresponding to the major peak in the temperature profile is referred to as the thermal phase transition temperature. Generally a high TPTT corresponds to a high softening temperature of the material.

Therefore, the present invention relates to an aqueous liquid fabric-treatment composition comprising i) a water-insoluble cationic fabric-conditioning material, and ii) a hydrocarbon composition having a thermal phase transition temperature of between 27° C. and 38° C.

The water-insoluble cationic fabric softener can be any fabric-substantive cationic compound that has a solubility in water at pH 2.5 and 20° C. of less than 10 g/l. Highly preferred materials are quaternary ammonium salts having two $C_{12}$-$C_{24}$ alkyl or alkenyl chains, optionally substituted or interrupted by functional groups such as —OH, —O—, —CONH, —COO—, etc.

Well-known species of substantially water-insoluble quaternary ammonium compounds have the formula:

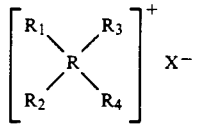

wherein $R_1$ and $R_2$ represent hydrocarbyl groups of from about 12 to about 24 carbon atoms, $R_3$ and $R_4$ represent hydrocarbyl groups containing from 1 to about 4 carbon atoms, and X is an anion, preferably selected from halide, methyl sulphate and ethyl sulphate radicals. Representative examples of these quaternary softeners include ditallow dimethyl ammonium chloride, ditallow dimethyl ammonium methyl sulphate, dihexadecyl dimethyl ammonium chloride, di(hydrogenated tallow alkyl) dimethyl ammonium chloride, dioctadecyl dimethyl ammonium chloride, dieicosyl dimethyl ammonium chloride, didocosyl dimethyl ammonium chloride, di(hydrogenated tallow) dimethyl ammonium methyl sulphate, dihexadecyl diethyl ammonium chloride and di(coconut alkyl) dimethyl ammonium chloride. Ditallow dimethyl ammonium chloride, di(hydrogenated tallow alkyl) dimethyl ammonium chloride, di(coconut alkyl) dimethyl ammonium chloride and di(coconut alkyl) dimethyl ammonium methosulphate are preferred. Other preferred quaternary ammonium compounds are disclosed in EP 239 910.

Another class of preferred water-insoluble cationic materials are the alkyl imidazolinium salts believed to have the formula:

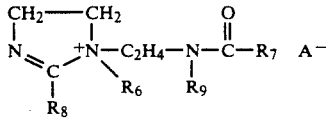

wherein $R_6$ is an alkyl or hydroxyalkyl group containing from 1 to 4, preferably 1 or 2 carbon atoms, $R_7$ is an alkyl or alkenyl group containing from 8 to 25 carbon atoms, $R_8$ is an alkyl or alkenyl group containing from 8 to 25 carbon atoms, and R9 is hydrogen or an alkyl group containing from 1 to 4 carbon atoms and $A^-$ is an anion, preferably a halide, methosulphate or ethosulphate. Preferred imidazolinium salts include 1-methyl-1-(tallowylamido) ethyl-2-tallowyl-4,5-dihydroimidazolinium methosulphate and 1-methyl-1-(palmitoylamido) ethyl-2-octadecyl-4,5-dihydroimidazolinium chloride. Other useful imidazolinium materials are 2-heptadecyl-1-methyl-1-(2-stearylamido) ethyl-imidazolinium chloride and 2-lauryl-1-hydroxyethyl-1-oleyl-imidazolinium chloride. Also suitable herein are the imidazolinium fabric-softening components of U.S. Pat. No. 4,127,489, incorporated by reference.

Other suitable cationic softener materials for use in compositions of the present invention are amines which are used at relatively low pH values to effect at least the partial protonation thereof. Suitable water-amine fabric softeners have, in protonated form, a solubility in water at pH 2.5 and 20° C. of less than 10 g/l.

Preferably the relatively in-soluble amine materials are selected from the following groups:

(i) amines of formula

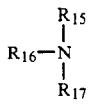

(I)

wherein $R_{15}$, $R_{16}$ and $R_{17}$ are defined as below;

(ii) imidazolines of formula

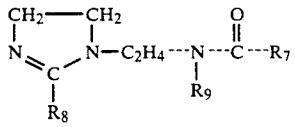

III wherein $R_7$, $R_8$ and $R_9$ are defined as above.

(iii) condensation products formed from the reaction of fatty acids with a polyamine selected from the group consisting of hydroxy alkylalkylenediamines and dialkylenetriamines and mixtures thereof. Suitable materials are disclosed in European Patent Application 199 382 (Procter and Gamble), incorporated herein by reference.

When the amine is of the formula I above, $R_{15}$ is a $C_6$ to $C_{24}$, hydrocarbyl group, $R_{16}$ is a $C_1$ to $C_{24}$ hydrocarbyl group and $R_{17}$ is a $C_1$ to $C_{10}$ hydrocarbyl group. Suitable amines include those materials from which the quaternary ammonium compounds disclosed above are derived, in which $R_{15}$ is $R_1$, $R_{16}$ is $R_2$ and $R_{17}$ is $R_3$. Preferably, the amine is such that both $R_{15}$ and $R_{16}$ are $C_6$–$C_{20}$ alkyl with $C_{16}$–$C_{18}$ being most preferred and with $R_{17}$ as $C_{1-3}$ alkyl, or $R_{15}$ is an alkyl or alkenyl group with at least 22 carbon atoms and $R_{16}$ and $R_{12}$ are $C_{1-3}$ alkyl.

Preferably these amines are protonated with hydrochloric acid, orthophosphoric acid (OPA), $C_{1-5}$ carboxylic acids or any other similar acids suitable for use in the fabric conditioning compositions of the invention.

The hydrocarbon composition can be composed of various fabric-substantive hydrocarbon materials, each being suitable for inclusion in fabric-treatment compositions, provided that the total hydrocarbon composition has a TPTT of between 27° and 38° C.

Suitable hydrocarbon materials for use in the hydrocarbon composition include hydrocarbon materials comprising a linear or branched alkyl chain and preferably comprising an average of from 12 to 50 carbon atoms per molecule, preferably from 12 to 30 carbon atoms. Preferably, the hydrocarbon materials are either alkanes or alkenes. Relatively small amounts of nonalkyl substituent groups may be present, provided the hydrocarbon nature of the product is not substantially affected.

Examples of suitable hydrocarbon materials for use in the hydrocarbon composition are the liquid hydrocarbon materials of natural source. Other liquid hydrocarbon materials including the liquid fractions derived from crude oil, such as mineral oil or liquid paraffins and bracked hydrocarbons.

Examples of solid or semi-solid hydrocarbon materials are the paraffinic materials of longer chain length, and hydrogenated versions of some of the liquid materials mentioned above.

A particularly useful combination of hydrocarbon materials is a mixture of mineral oil (M85 ex Daltons Company) and petroleum jelly (Silkolene 910 ex Daltons), wherein the weight ratio of mineral oil to petroleum jelly is chosen such that the TPTT of the mixture is more than 27° C. and less than 38° C. In our experiments this result was obtained by using a ratio of mineral oil to petroleum jelly of less than 3:1, preferably from 2:1 to 1:3. Mineral oil is a liquid mixture of linear and branched hydrocarbons having an average number of carbon atoms per molecule of 26. Petroleum jelly is a semi-solid mixture of linear and branched hydrocarbons having an average number of carbon atoms per molecule of 26, and having a softening temperature of about 50° C.

Fabric-treatment compositions according to the present invention will preferably have a total level of water-insoluble cationic material and hydrocarbon composition of from 2 to 70% by weight of the composition, the remainder of the composition being predominantly water optionally plus minor ingredients. Preferably, the total amount of water-insoluble cationic material and hydrocarbon composition is more than 3% by weight, more preferably between 4 and 50% by weight, most preferably between 8 and 35% by weight, the amount especially preferred being between 15 and 25% by weight. An especially preferred composition comprises from 1.5% to 5.5% by weight water-insoluble cationic material and from 6% to 29% hydrocarbon material.

The weight ratio of water-insoluble cationic material to hydrocarbon composition can be varied in a broad range, but is preferably between 10:1 and 1:10, more preferably between 5:1 and 1:7, the range from 2:1 to 1:5 being especially preferred.

The pH of the fabric-treatment composition is preferably between 2 and 7, more preferably from 3 and 6, especially preferred from 3 to 4.5. The viscosity of the fabric-treatment composition is preferably less than 200 cPs at 110 $s^{-1}$ (Haake viscometer).

In addition to the water-insoluble cationic material and the hydrocarbon composition, the fabric-treatment composition may comprise one or more ingredients which are suitable suitable for incorporation in fabric-treatment compositions. Examples of these optional ingredients are nonionic, amphoteric or zwitterionic fabric-treatment materials. Especially preferred is the use of glycerol monostearate.

The compositions may also contain, in addition to the cationic fabric softening agent, other non-cationic fabric softening agents, such as nonionic fabric softening agents. Suitable nonionic fabric softening agents include glycerol esters, such as glycerol monostearate, fatty alcohols, such as stearyl alcohol, alkoxylated fatty alcohols $C_9$–$C_{24}$ fatty acids and lanolin and derivatives thereof. Suitable materials are disclosed in European Patent Application 88 520 (Unilever PLC/NV case C 1325), 122 141 (Unilever PLC/NV case C 1363) and 79 746 (Procter and Gamble), the disclosures of which are incorporated herein by reference. Typically such materials are included at a level within the range of from 0.5% to 10% by weight of the composition.

The compositions may also contain one or more ingredients selected from non-aqueous solvents such as $C_{1-C4}$ alkanols and polyhydric alcohols, pH-buffering agents such as weak acids, e.g. phosphoric, benzoic or citric acid (the pH of the compositions being preferably less than 6.0), rewetting agents, viscosity modifiers, silicones, anti-gelling agents, perfumes, perfume carriers, fluorescers, colourants, hydrotropes, antifoaming agents, anti-redeposition agents, enzymes, optical brightening agents, opacifiers, stabilizers such as guar gum and polyethylene glycol, anti-shrinking agents, anti-wrinkle agents, fabric-crisping agents, spotting agents, soil-release agents, germicides, fungicides, antioxidants, anti-corrosion agents, preservatives, dyes, bleaches and bleach precursors, drape-imparting agents and antistatic agents.

Preferably the level of solvent materials as referred to above is less than the level of cationic fabric softener materials in the composition. More preferably the level of solvents is less tham 75 %, more preferred less than 50 % based on the weight of the cationic fabric softener material. Typically compositions of the invention are substantially free from solvents.

Advantageously, the fabric-treatment composition according to the invention also comprises a small amount of water-soluble cationic material. Examples of suitable materials of this nature are given in GB 1,601,360. Other suitable water-soluble cationic materials include polyamine materials, preferably diamine materials, wherein each nitrogen atom is connected to three other atoms. A preferred diamine water-soluble cationic material of this nature is Ethoduomeen T13 (ex AKZO Chemie) which is an N,N',N'-tris (2-hydroxyethyl) N-tallow 1,3-diaminopropane. The amount of water-soluble cationic material is preferably less than the amount of water-insoluble cationic material. Preferably the amount of water-soluble cationic material will be from 0.5 to 10% by weight of the composition.

Compositions according to the invention can be prepared by any method suitable for preparing dispersed, emulsified systems. A preferred method involves the forming of a molten premixture of the active materials in water at an elevated temperature, adding additional water to obtain the desired active concentration, and then cooling to ambient temperature. When desired, some minor ingredients such as electrolytes, colouring agents, etc. may be post-dosed. A second preferred method involves the forming of the product by phase inversion of a water in hydrocarbon emulsion, wherein the xationic material is either part of the hydrocarbin phase or added as a separate predispersion. This method is especially advantageous, because this provides very finely divided hydrocarbon particles in the final product.

In use, the fabric-treatment compositions according to the invention are preferably used in the final rinse of the washing cycle of an ordinary washing machine. The amount of fabric-treatment composition to be added is mainly dependent on the active concentration of the composition and the volume of the water used in the rinsing cycle. Preferably, the dose is chosen such that the concentration of active material (softener plus hydrocarbon material) in the rinse water is from 0.05 to 3.0 g/1, preferably from 0.5 to 2.0 g/l.

BRIEF DESCRIPTION OF THE DRAWINGS

FIG. I shows a temperature profile measured with the Perkin & Elmer thermal analysis system for compositions referred to in Example I below.

FIG. II is a graphical illustration of the fabric softening scores and creasing scores for the same compositions.

EXAMPLES

The invention will be further illustrated by means of the following examples.

EXAMPLE I

Fabric-treatment compositions A-F were prepared as follows. The cationic materials and the hydrocarbon materials were mixed, melted and heated to a temperature of 70° C. The molten actives were added to water of 70° C. while mixing at high speed with a Silverson mixer. After being mixed for 10 minutes, the compositions were cooled to room temperature by rapid chilling in an ice bath while being stirred gently.

The following compositions were obtained. All amounts are in weight percentages, related to the total composition.

| | A | B | C | D | E | F |
|---|---|---|---|---|---|---|
| Arquad 2HT | 5 | 5 | 5 | 5 | 5 | 5 |
| M85 | 15 | 11.3 | 10 | 7.5 | 3.7 | — |
| Petroleum jelly | — | 3.7 | 5 | 7.5 | 11.3 | 15 |
| Ethoduomeen | 2 | 2 | 2 | 2 | 2 | 2 |
| water | | | balance | | | |
| TPTT hydrocarbon composition | <<20° C. | 25° C. | 28° C. | 32° C. | 37° C. | 39.5° C. |

The TPTT of the hydrocarbon material was measured by using the Perkins & Elmer thermal analysis system. The temperature profiles of the hydrocarbon compositions as used in the compositions B-F are shown in FIG. I. For the mineral oil no temperature profile is given, as the TPTT value for this material would be far less than 20° C.

Compositions A-F were tested as follows:

Softness assessment 4 pieces of harshened terry towel and 8 pieces of unharshened terry towel, the 12 pieces weighing in total 150 g, were rinsed at room temperature for 5 minutes in 1 liter of demin-water with 1 g of fabric-conditioning composition. The pieces of towel were squeezed to remove excess water, spin-dried for 30 seconds and line dried. The pieces of towel were assessed by a trained panel of 4 persons by the Round Robin method. The softening score was expressed in arbitrary units, a higher softening score indicating a better softening.

Creasing assessment

Two pieces of 9×9 inches of 50/50 polyester/cotton, two pieces of 9×9 inches of 67/33 polyester/cotton and two pieces of 9×9 inches of cotton/poplin were rinsed at room temperature for 5 minutes in 1 liter of demin-water with 1 g of fabric-conditioning composition. The fabrics were squeezed to remove excess water, spun for 10 seconds, further squeezed in a clenched fist for 10 seconds and subsequently line dried. The pieces were assessed by a trained panel of 4 persons by the Round Robin method. The creasing score was expressed in arbitrary units, a higher creasing score indicating less creasing.

The results of the tests are represented in FIG. II. This figure clearly shows that hydrocarbon compositions C–E having a TPTT of between 27° and 38° C. show a perfect balance of a good creasing score and adequate softening performance.

Composition A, outside the invention and not shown in FIG. II, shows a softening which is slightly better than composition B, but has a significantly lower creasing score than compositions C–E.

Composition B, outside the invention, is unsatisfactory in that a low creasing score is found. Composition F, outside the invention, is unsatisfactory in that the softening score is unacceptably low.

EXAMPLE II

The following composition was prepared:

| | % |
|---|---|
| M85 | 12.3 |
| Petroleum jelly | 6.1 |
| Adogen 442 | 4.6 |
| Ethoduomeen | 1.5 |
| Calcium chloride | 0.01 |
| minor amounts of colouring agents, perfumes | |

This composition showed a satisfactory balance of anti-wrinkling and softening.

| Specification of materials | |
|---|---|
| Arquad 2HT | di-hardened tallow-dimethyl ammonium chloride (ex Atlas) |
| Adogen 442 | di-hardened tallow-dimethyl ammonium chloride |
| M85 (ex Daltons) | mineral oil, average C number of 24 |
| Petroleum jelly | Silkolene 910 ex Daltons Company, average C number of 26 |
| Ethoduomeen T13 (AKZO) | N,N',N'-tris (2-hydroxyethyl) N-tallow 1,3-diaminopropane. |

-continued

| Chemical | Trade Name | Supplier | A Level (as 100% ai) | B Level (as 100% ai) |
|---|---|---|---|---|
| Dihardened tallow dimethyl ammonium chloride | ADOGEN 442 | SHEREX | 3.3 | 3.3 |
| Mineral oil | Sirius 85 | Daltons Co | 10.8 | 10.8 |
| Pet jelly | Silkolene 910 | Daltons Co | 5.4 | 5.4 |
| Dicoco dimethyl ammonium chloride | Adogen 462 | Sherex | 2.2 | 2.2 |
| Glycerol monostearate | — | Unichema | 1.65 | 1.65 |
| $C_{12}$–$C_{15}$ alcohol 3 ethoxylate | Dobanol 25-3 | Shell UK Ltd. | 1.1 | 1.1 |
| N,N,N-tris-(2 hydroxy(ethyl)-N-tallow-1,3-diamino propane | Ethoduomeen T13 | Akzo | 1.24 | 1.24 |
| Preservative | Proxel XL2 | ICI | 0.02 | 0.02 |
| Perfume | Koala 188 | IFF | 0.60 | 0.60 |
| Dye | DAB AE | Cassella | 0.004 | 0.004 |
| Amine functional | TP 226 | Union Carbide | 1.5 | 1.5 |
| Water | | | to balance | |

The above compositions were made by preheating the Sirius 85, the Silkolene 920, the Adogen 462, the GMS and the Dobanol 25–3 to 60° C. and adding water to this premix under stirring. This provides a water in oil type emulsion, which upon further addition of water is phase reversed to a oil in water type emulsion, wherein the oil phase is very finely dispersed. To this oil in water phase is added a predispersion of the Adogen 442 and the Etoduomeeen T13, which had been prepared by heating the two materials to 60° C. followed by the addition to water under stirring. The final product is obtained by adding the remaining ingredients to the mixture of the two dispersions.

I claim:

1. An aqueous liquid fabric-treatment composition comprising (i) a water-insoluble cationic fabric-conditioning material; and (ii) a hydrocarbon composition which is a mixture of a liquid hydrocarbon material and a semi-solid or solid hydrocarbon material, said materials being in a weight ration which lies in a range from 3:1 to 1:3 the ratio of water-insoluble cationic material to hydrocarbon mixture being about 10:1 to 1:10 and said hydrocarbon composition having a thermal phase transition temperature, associated with softening of the composition, which lies between 27° and 38° C.

2. An aqueous liquid fabric-treatment composition according to claim 1, characterised in that it has a viscosity of less than 200 cPs at 100 $s^{-1}$.

3. A composition according to claim 1, comprising

30 - 98% by weight water and

2 - 70% active material comprising the water-insoluble cationic material and the hydrocarbon composition.

4. A composition according to claim 1, characterised in that the active material also comprises a water-soluble cationic fabric-conditioning material.

5. A composition according to claim 1, characterised in that it comprises:

i) 55.5 –92% water ii) 1.5 –5.5% water-insoluble cationic material iii) 6 –29% hydrocarbon composition iv) 0.5 –10% water-soluble cationic material.

6. Use of a composition according to claim 1 in the rinse cycle of a fabric washing process.

* * * * *